United States Patent [19]

deGroot

[11] Patent Number: 4,913,290

[45] Date of Patent: Apr. 3, 1990

[54] COLLAR FOR PALLETIZED LOAD

[75] Inventor: Peter F. deGroot, Monterey, Calif.

[73] Assignee: Bud Antle, Inc., Salinas, Calif.

[21] Appl. No.: 303,352

[22] Filed: Jan. 26, 1989

[51] Int. Cl.[4] ..... B65D 19/00

[52] U.S. Cl. ..... 206/597; 206/386; 206/821; 229/DIG. 11

[58] Field of Search ..... 206/286, 501, 503, 597, 206/600, 821; 229/DIG. 11

[56] References Cited

U.S. PATENT DOCUMENTS

| | | | |
|---|---|---|---|
| 2,925,947 | 2/1960 | Brown | 206/600 |
| 3,490,583 | 1/1970 | Cook | 206/503 |
| 3,635,361 | 1/1972 | Hayes | 206/503 |
| 3,659,707 | 5/1972 | Nilson et al. | 206/597 |
| 4,365,710 | 12/1982 | Swanson | 206/386 |
| 4,467,918 | 8/1984 | Blot | 206/503 |
| 4,638,941 | 1/1987 | Watson | 206/821 |
| 4,735,321 | 4/1988 | Day | 206/597 |
| 4,799,593 | 1/1989 | Lawrence | 206/821 |

FOREIGN PATENT DOCUMENTS

| | | | |
|---|---|---|---|
| 2721482 | 11/1978 | Fed. Rep. of Germany | 206/386 |

*Primary Examiner*—David T. Fidei

*Attorney, Agent, or Firm*—Townsend and Townsend

[57] ABSTRACT

In combination with a carton stacked pallet, a collar is disclosed for indexing to an interstitial layer of cartons on the pallet for stabilizing the palletized stack of cartons above and below the collar both during and after palletization. The collar preferably consists of a continuous piece of corrugated board having a length corresponding to the circumference of the four sides of the palletized load to be enclosed. The corrugated board of the collar is folded and fitted to each of the four sides of the palletized cartons. A gusset member protrudes normally inward from each of the four collar sides for entrapment between the interstitial layers of the of cartons of the palletized load of cartons. At the palletizing site, the band is unfolded into a rectangular carton surrounding configuration with the folded gussets disposed to the inside. The pallet is partially stacked with a rectilinear sectioned stack of cartons to expose the top of a continuous interstitial layer of the cartons at a partial height of the ultimately palletized load. The collar is registered to the top of the continuous interstitial layer so the bottom portion of the collar below the gusset confines and stabilizes the top cartons on the pallet. When layers of further cartons are placed within the collar on the gusset there results a combination of forces stabilizing the palletized cartons below and above the collar both during and after the palletizing process.

5 Claims, 4 Drawing Sheets

COLLAR FOR PALLETIZED LOAD

This invention relates to pallets, cartons stacked on pallets in rectilinear sectioned arrays, and more particularly to a collar for surrounding stacked cartons on a pallet to impart columnar stability to a group of palletized cartons.

SUMMARY OF THE PROBLEM

The stacking of cartons on pallets to heights suitable for shipping presents load stability problems. Typically, such stacks of cartons have columnar instabilities interfering with the intended and normal height of the load. These columnar instabilities result from a combination of factors and makes the process of palletizing the cartons difficult.

First, the sides of cartons are smooth. The cartons as stacked frequently slide, one with respect to another. Additionally, if there is any tendency of the cartons to be rounded (as in the produce industry), the columnar stability is aggravated. When the cartons are out of round, the sides of the carton do not precisely align themselves one with another. The cartons do not a reliably stack. Additionally, and where the cartons are light, further instabilities occur as the stacked cartons do not conform themselves at their carton to carton interface to their stack disposition.

Second, it is known that the wrapping of palletized cartons improves the stability of cartons once the cartons have been successfully located on a pallet. Typically, when the cartons are completely stacked on a pallet, wrapping material such as stretch wrap, is spiral wound about the cartons. Such wrapping often includes a wrapping dispenser and a rotating pallet supporting platform. When the platform is rotated, the stretch wrap is serially dispensed to bind the palletized carton into a unitary mass.

Unfortunately such machinery is unsuitable in many locations.

First, the equipment is expensive.

Second, such equipment is completely unsuitable in an agriculture environment where palletizing of produce packed cartons occurs in the field.

It is to be noted that the stability of a stack is required during the time the palletizing occurs. Even with the automatic pallet wrapping equipment set forth, stabilizing of the stack during the palletizing process does not occur.

It should be noted that systems of corner reinforcing angles bound with rope or straps have been used for the stabilizing of cartons. These systems do not assist stability during the palletization process.

SUMMARY OF THE INVENTION

In combination with a carton stacked pallet, a collar is disclosed for indexing to an interstitial layer between cartons for stabilizing the palletized stack of cartons both during and after palletization.

The construction of a preferred embodiment of the collar is easy to understand. The collar preferably consists of a continuous piece of corrugated board having a length corresponding to the rectilinear perimeter of the palletized load to be enclosed. The collar folds to four linear joined sides corresponding to the respective length and width of the rectilinear sectioned palletized load for reinforcing and bracing a palletized load.

The corrugated board of the collar has a width approximately twice the intended width of the collar surrounding the palletized carton. The cardboard is folded at a folded over section parallel to the length of its perimeter to impart a double thickness to one-half of the collar entirely around the circumference of the collar. The folded over cardboard section is slotted normally to the circumference from one side edge approximately one-half of the thickness of the collar. This slotting is coincident to each of the corner locations of the rectilinear section pallet.

Second folds are introduced between the ends of the slots parallel to the circumference of the collar. These second folds create gusset members folding to the inside of the collar for entrapment between the interstitial layers of cartons of the palletized load of cartons. The collar is made into a continuous and endless band at a fastening flap, folded upon itself into a flat and preferably stacked disposition and shipped in a collapsed disposition to a palletizing site for assembly and use.

The dimensional proportions and strength of the collar may be custom tailored to the requirement of the particular carton stack reinforced.

At the palletizing site, the collar is unfolded to a rectangular configuration which is the precise rectangular configuration of the ultimately palletized cartons. Folding of the gussets between the slots occurs with the gussets being disposed at right angles to the collar sides. The gussets are typically arrayed with their respective corners being disposed in a so-called "French fold" so as to brace the gussets normally to the inside of the collar. Other forms of normal bracing of the gusset can be used. The normally disposed gussets brace the collar into a rectangular pallet surrounding configuration.

The pallet is partially stacked to expose the top of a continuous interstitial layer at a partial height of the ultimately palletized load. The collar is registered to the top of the continuous interstitial layer so the bottom portion of the collar below the gusset confines and stabilizes the cartons below the collar on the pallet. When layers of further cartons are placed within the collar on the gusset to extend above the collar, there results a combination of forces stabilizing the palletized carton against columnar collapse.

First, the gussets are at right angles to the collar and reinforce the longitudinal dimension of the collar with a right angle beam action.

Second, the gussets are trapped at the interface between the cartons by the weight of the cartons. The gussets, in their attachment to the linear sides of the collar, prevent the collar from pulling or bulging outwardly.

Finally, the gussets, as trapped between the cartons, are prevented from folding and thus maintained linear. The linear and rigid gussets corresponding impart rigidity to the collar by a right angle beam action.

There results a stabilizing collar which avoids the necessity of expensive pallet wrapping equipment. The collar folds into its functional configuration at the palletizing site without further equipment. Further, the collar assists in the stabilization of the load during the critical time while the pallet is in the process of being stacked.

BRIEF DESCRIPTION OF THE DRAWINGS

Other objects, features and advantages of this invention will be more apparent after referring to the following specification and attached drawings in which;

Referring to FIG. 1A a collar B is shown in the unassembled disposition. Collar B has a length corresponding to the rectilinear perimeter of the carton loaded pallet to be stabilized. The collar B includes two prefold lines. These prefold lines extending the length of the rectilinear perimeter collar. These prefold lines include folds 16 and 18.

Additionally, the collar B include three slots 20, 23 and 25. These respective slots divide the four respective linear sides of the collar into sections having the respective length and width of the rectilinear section of the carton stacked pallet to be stabilized. As can be seen, the slots extend from a side edge of the collar to the fold line 18. This enables those portions of the collar B between the slots to fold outwardly normal to the sides of the collar at separate gussets G1, G2, G3 and G4.

Finally, there is included an end tab 30. End tab 30 enables fastening of the collar B in an endless rectilinear disposition for surrounding a correspondingly rectilinearly sectioned group of cartons on a pallet.

It may be desirable to provide tensile reinforcement to the collar B. According to that aspect of the invention, there can be placed within the material of the collar, fibers 40, 42. These fibers 40, 42 reinforce the collar circumferentially. Additionally, and should a tear commence to propagate along the collar, the fiber will interrupt the tear and prevent parting of the collar normal to its circumference.

Figure 1B:
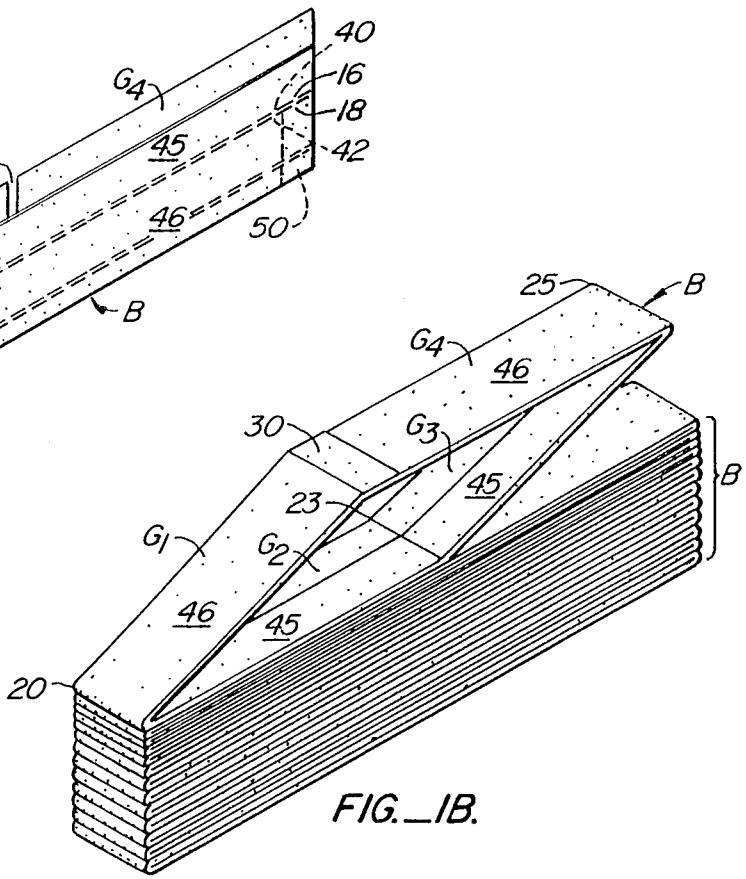
FIG. 1B is a perspective of the collar of FIG. 1A, prefolded and fastened into an endless pallet surrounding collar with successive collar s being stacked and ready for shipment to a palletizing site.
Figure 1A:
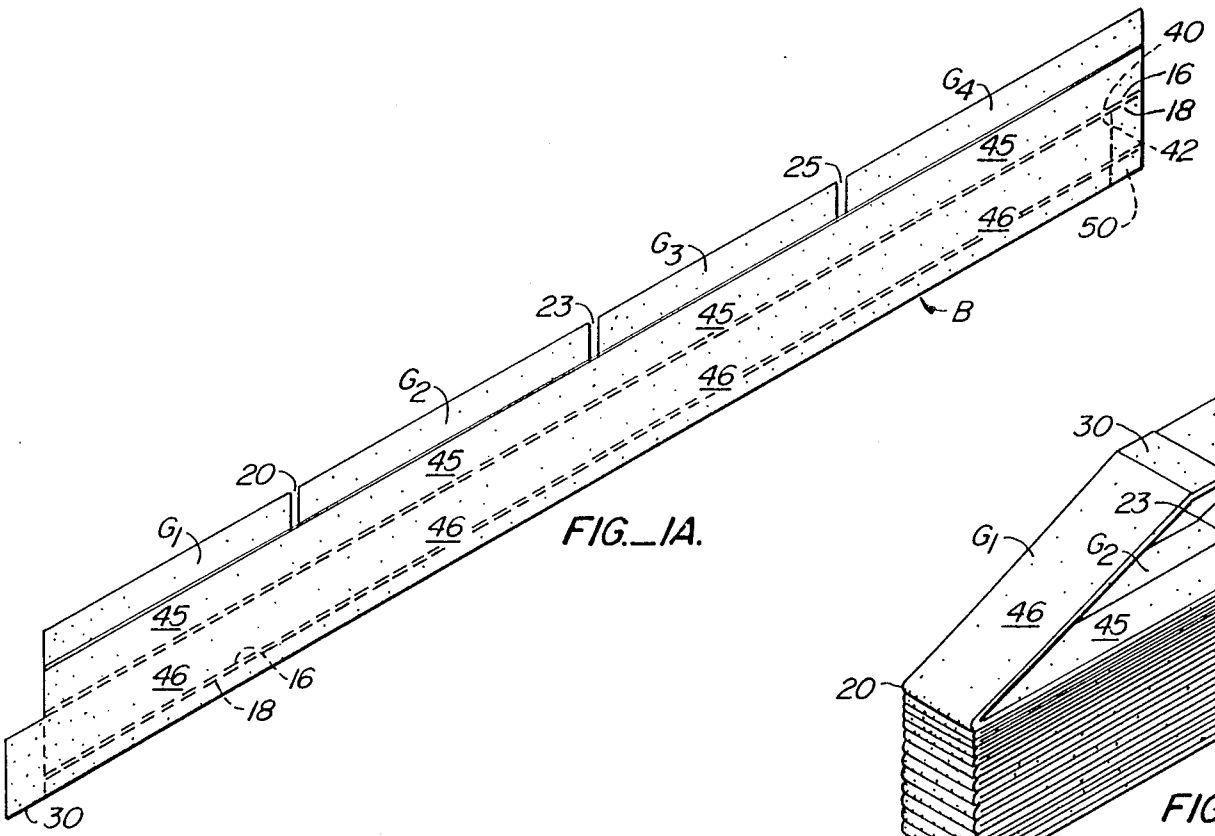
FIG. 1A is a perspective view of a cut slotted and prefolded cardboard strip before being fastened into an endless carton surrounding collar.

Assembly and shipment of the collar can best be seen with respect to FIG. 1B. Specifically, the collar is first folded along centerfold line 16. Typically, the panel 45 is glued to the panel 46 so as to form a double thickness portion of the collar. This double thickness of the collar extends entirely around the periphery of the collar. Thereafter, tab 30 on one end of collar B fastens at a corresponding portion 50 on the opposite end of collar B.

Referring to FIG. 1B, the assembled collar can be seen.

Referring to FIG. 1B, a final assembled collar B having its overlapping flap 30 fastened to area 50 to form a continuous surrounding cardboard collar is illustrated. Collar B includes four linear banding surfaces 4 and gussets G1, G2, G3, and G4, each gusset attached at a prefold line 18 to a linear side of the collar. It can be seen that gussets G1, G2, G3 and G4 are disposed parallel to the material of the collar. As will hereafter be set forth, all gussets will be deployed by folding inwardly of collar B once the collar is opened.

Figure 1C:
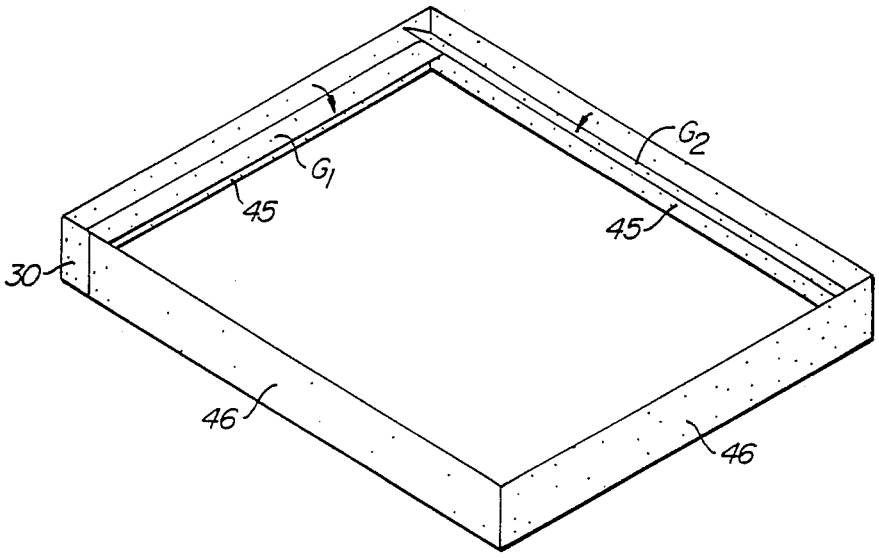
FIG. 1C is a perspective illustrating the unfolding of the collar for use.

Below the single collar B which is the process of being assembled, there is shown a stack of bands. These respective bands B are in a disposition for shipment to a palletizing site Referring to FIG. 1C, the collar B is shown in the process of being assembled. It has first been opened to a rectilinear disposition. Gusset G1 has been folded downwardly inward normal to the linear side 46 of the collar B. Gusset G2 is in the process of being folded down normally inward. This process will sequentially follow with gussets G3 and G4. The end of gusset G4 will be tucked under gusset G1 to complete the so-called "French fold."

Figure 2C:
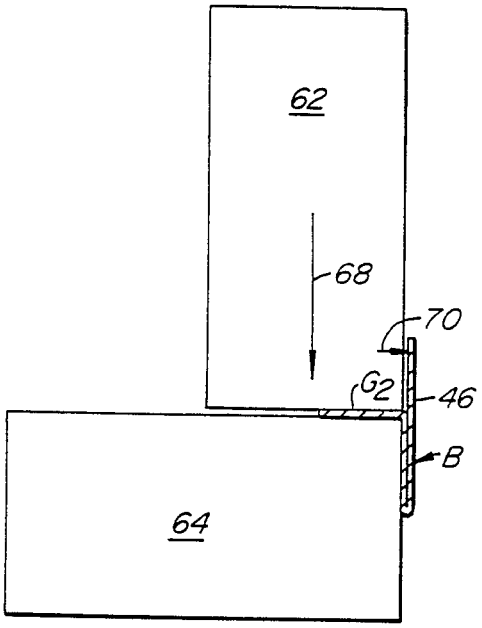
FIG. 2C is a detail illustrating the synergistic action between the gusset and collar sides wherein the gusset as trapped between the stacked cartons reinforces the collar sides.
Figure 2A:
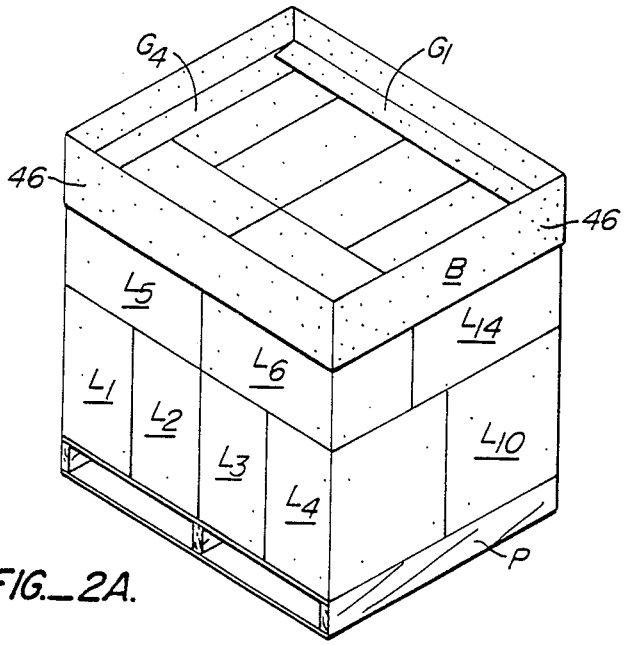
FIG. 2A is a perspective of a partially stacked pallet having an upwardly continuous interstitial layer having one of the collars registered at the top of the cartons for placement intermediately of the palletized load.

Referring to FIG. 2A, a pallet P is shown at their palletizing site. Pallet P includes lettuce cartons stacked thereon. In this particular example, a total number of 14 boxes (here packed with produce) are packed on the pallet P.

Referring to FIG. 2A, the packed lettuce boxes include boxes L1 through L4 standing on end on their sides. Lettuce boxes L5 and L6 are flat and dispose their respective tops at an even level. It can be seen that boxes L1–L6 occupy the left one-thirds of the pallet.

Similarly, and on the right two-thirds of the pallet, boxes L7 through L10 are on their side on a lower layer with boxes L11 through L14 stacked on their sides on top. The top sides of boxes L11–L14, like the tops of boxes L5–L6 are disposed at the same level.

Collar B has been lifted to the top of the partially stacked pallet. Gussets G1 and G4 can be seen. These gussets are disposed normally inward of the linear sides of the collar in a so-called self-bracing "French fold". The gussets G1–G4 are all held in a normal relation relative to the material of the band B.

As can be understood, it is necessary that the respective boxes L5 and L6 as well as boxes L11–L14 be drawn inwardly so that collar B fits over the top of the boxes. At the same time, the gussets G1–G4 all register to the top surface of the boxes. In effecting this registration, the tops of the boxes on the pallet P are contained one to another to prevent shifting with resultant columnar collapse.

Figure 2B:
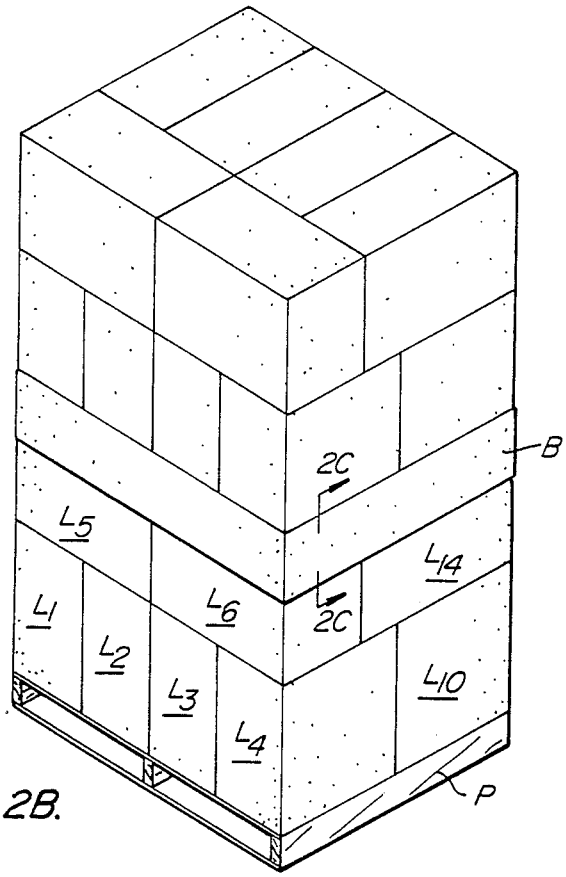
FIG. 2B is a perspective similar to FIG. 2A illustrating remaining cartons being placed above the collar for stabilization of the load on the pallet during the process of palletizing the cartons.

Referring to FIG. 2B, the boxes of FIG. 2A are shown. On top of these boxes has been loaded a second, continuing layer of boxes. From this it can be seen that collar B stabilizes boxes below the collar as well as boxes above the collar. This columnar stabilization is here shown occurring during the palletizing process.

Referring to FIG. 2C, the collar B is shown in section with the gusset G2 trapped by the weight of overlying carton 62 to the top of the underlying carton 64. Gusset G2 fastens to the side 46 of collar B. Gusset G2 prevents the force of columnar collapse (indicated by vector 70) from causing outward movement of carton 62. As this force will act on all cartons around the periphery of collar B, the synergistic reinforcement of the carton stack at its four rectilinear sides of the pallet P can be understood.

Figure 3:
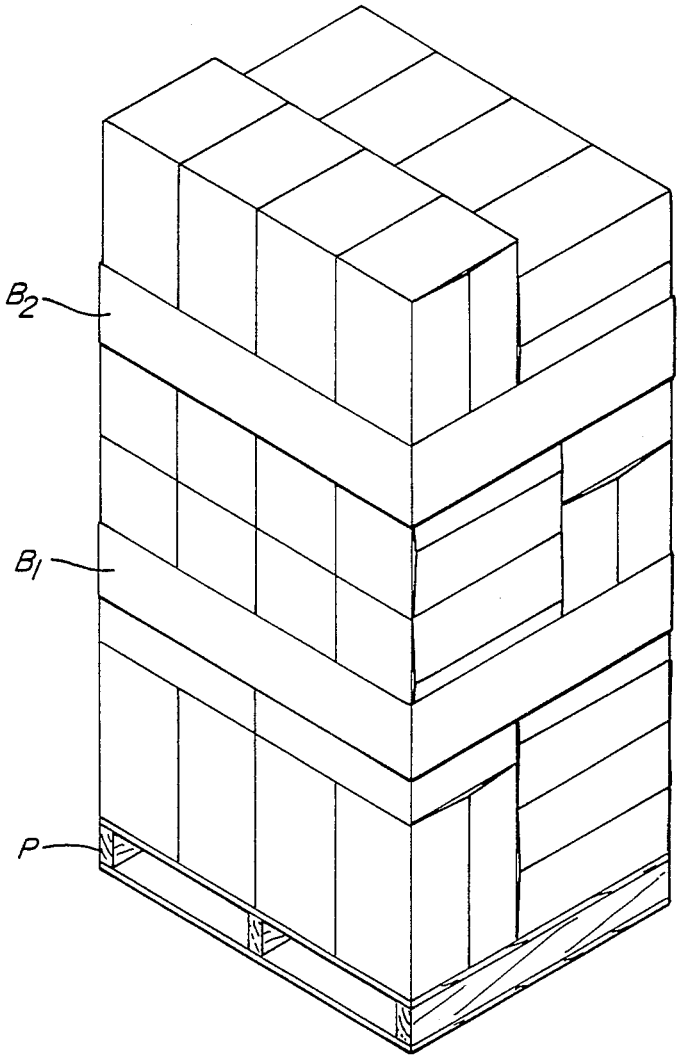
FIG. 3 is a perspective similar to FIG. 2B with the ultimately reinforced and stacked palletized load ready for shipment.

Finally, and referring to FIG. 3, a full stack is illustrated. The full stack includes a first collar B1 and a second collar B2 stabilizing over a single pallet P.

It will be appreciated that the collar is preferably made of corrugated paper. It should be understood other semirigid materials will do as well.

What is claimed:

1. In combination with a loading pallet and cartons stacked on said pallet in rectilinear section to define four corners to said loaded pallet, said cartons defining a substantially parallel interface between said pallet and a partial height of said pallet, a collar for reinforcing said cartons against columnar collapse during and after pelletizing said pallet, said collar comprising:

a collar fabricated from semi-rigid foldable material, said collar having a periphery, said periphery being equal in parametric length to the corresponding sides and widths of said cartons as stacked in a rectilinear sectioned stack on said pallet;

said collar defining linear sides, said linear sides being joined at four parallel folds across said collar, said folds enabling said collar to fold from a first disposition wherein said collar linear sides overlie one another to a second disposition where said collar sides register to each of the four linear sides of said cartons stacked on said pallet;

a gusset attached to each linear side, said gusset foldable from a first disposition parallel to the linear side of said collar to a second disposition protruding at right angles from said collar to and towards the interior of said collar whereby said gusset reinforces the linear sides on said collar and can be trapped between said parallel interface of said stacked boxes;

each said gusset as folded to said second disposition extending only a partial distance across said collar to an opposite gusset.

2. In combination;

a pallet;

cartons stacked on said pallet in a columnar disposition, said cartons defining between the top of said stack and said pallet an intermediate layer disposed all at the same level, said cartons as stacked on said pallet defining a rectilinear periphery having four sides;

a collar fabricated from semi-rigid foldable material, said collar having a rectilinear periphery, said periphery being equal in dimension to the rectilinear periphery of said cartons as stacked on said pallet;

said collar defining an inwardly protruding gusset, said gusset protruding at right angles from said collar to and towards the interior of said collar whereby said collar can be registered to said intermediate layer of cartons;

said collar includes four gusset members, said four gusset members being foldable with respect to the sides of said collar, said gusset folding from a first disposition parallel to the surface of said collar to a second disposition at right angles to said collar;

said cartons stacked above and below said collar on said gusset within the confines of said collar whereby said gusset is trapped by said cartons and said collar reinforces said cartons against columnar collapse above and below said collar and during stacking of said cartons on said pallet.

3. The invention of claim 2 and wherein said collar is fabricated from corrugated paper.

4. A process of stacking a pallet with a rectilinear stack of cartons comprising providing a pallet, said pallet having a rectilinear periphery;

partially stacking said pallet with a plurality of cartons, said cartons defining on said pallet a rectilinear periphery, said partial stack ending at an upper layer defined by a plurality of cartons, said upper layer being parallel to the surface of said pallet;

providing a collar fabricated from semirigid foldable material, said collar having a periphery, said periphery being equal to the circumference of said cartons as stacked on said collar;

folding said collar at said periphery into four linear sides, said sides being equal in length to the sides of the rectilinear periphery of said pallets on said collar;

attaching to each discrete linear side of said collar a discrete gusset, said gusset being foldable from a first disposition overlying said discrete linear side to a second disposition parallel to said linear side;

said gussets extending only a partial distance across said collar in said second disposition towards an opposite gusset attached to an opposite collar side; whereby said gusset reinforces the linear sides on said collar;

registering said collar at said linear gusset to said layer of cartons the partial height of said stack on said pallet;

and continuing to stack cartons above said collar within said collar trapping said gusset between said cartons for reinforcing said pallet of cartons against columnar collapse below said collar, above said collar, during and after pelletizing said cartons on said pallet.

5. The process of claim 4 and including the step of placing first and second collars at first and second elevations on said rectilinear stack of cartons on said pallet.

* * * * *